US011547903B1

(12) United States Patent
Hamilton

(10) Patent No.: US 11,547,903 B1
(45) Date of Patent: Jan. 10, 2023

(54) ROTATOR CUFF EXERCISE DEVICE

(71) Applicant: Meshach Hamilton, Dumfries, VA (US)

(72) Inventor: Meshach Hamilton, Dumfries, VA (US)

( * ) Notice: Subject to any disclaimer, the term of this patent is extended or adjusted under 35 U.S.C. 154(b) by 165 days.

(21) Appl. No.: 16/847,845

(22) Filed: Apr. 14, 2020

(51) Int. Cl.

| | |
|---|---|
| ***A63B 23/12*** | (2006.01) |
| ***A63B 21/00*** | (2006.01) |
| ***A63B 21/22*** | (2006.01) |
| ***A63B 23/035*** | (2006.01) |
| ***A63B 21/012*** | (2006.01) |
| ***A63B 71/06*** | (2006.01) |
| ***A63B 24/00*** | (2006.01) |

(52) U.S. Cl.
CPC .... *A63B 23/1272* (2013.01); *A63B 21/00069* (2013.01); *A63B 21/012* (2013.01); *A63B 21/22* (2013.01); *A63B 21/4035* (2015.10); *A63B 23/03508* (2013.01); *A63B 24/0062* (2013.01); *A63B 71/0622* (2013.01); *A63B 2071/0625* (2013.01); *A63B 2220/17* (2013.01); *A63B 2220/30* (2013.01); *A63B 2220/62* (2013.01); *A63B 2220/803* (2013.01); *A63B 2225/093* (2013.01)

(58) Field of Classification Search
CPC ... A63B 21/4035; A63B 21/012; A63B 21/22; A63B 21/015; A63B 21/4049; A63B 23/1272; A63B 23/03508; A63B 23/1245; A63B 23/1254; A63B 24/0062; A63B 21/00069; A63B 23/16; A63B 23/1209; A63B 71/0622; A63B 2071/0625; A63B 2225/093; A63B 2220/17; A63B 2220/30; A63B 2220/62; A63B 2220/803
See application file for complete search history.

(56) References Cited

U.S. PATENT DOCUMENTS

| | | | | |
|---|---|---|---|---|
| 2,530,921 | A * | 11/1950 | Tougas | A63B 21/008 482/119 |
| 3,013,799 | A * | 12/1961 | Wise | A63B 23/1245 482/118 |
| D304,058 | S | 10/1989 | Carlson | |
| 5,674,162 | A | 10/1997 | Ellingson | |
| 6,007,500 | A | 12/1999 | Quintinskie, Jr. | |
| 9,272,176 | B1 * | 3/2016 | Bendror | A63B 21/4035 |
| 9,358,414 | B2 | 6/2016 | Dephouse | |
| 9,427,372 | B1 * | 8/2016 | Minassian | A61H 1/0281 |

(Continued)

FOREIGN PATENT DOCUMENTS

| | | | | |
|---|---|---|---|---|
| CN | 105362039 A * | 3/2016 | | A63B 23/1272 |
| CN | 111035897 A * | 4/2020 | | |
| WO | 2001058535 | 8/2001 | | |

*Primary Examiner* — Joshua Lee

(57) ABSTRACT

The rotator cuff exercise device includes a ring unit, a mounting board, and a pair of mounting tracks. The rotator cuff exercise device may be adapted to exercise joints and muscles or may prevent the loss of flexibility in an elbow or a shoulder blade. The rotator cuff exercise device may be particularly suited for therapy after an injury involving a rotator cuff. A handle may detachably couple to an individual rotatable ring selected from one or more rotatable rings of the ring unit and may be adapted to be grasped by a hand of the user. The handle may be operable to move the individual rotatable ring in a circular motion. The circular motion of the handle may exercise the joints and muscles of the user.

15 Claims, 7 Drawing Sheets

(56) References Cited

U.S. PATENT DOCUMENTS

| | | | | |
|---|---|---|---|---|
| 10,413,778 | B2 | 9/2019 | Boddie | |
| 10,646,738 | B2 * | 5/2020 | Arturo | A63B 21/0557 |
| 2002/0107116 | A1 | 8/2002 | Schulz | |
| 2014/0296654 | A1 | 10/2014 | Breen | |
| 2020/0061413 | A1 * | 2/2020 | Cook | A63B 21/0628 |
| 2021/0245004 | A1 * | 8/2021 | Minassian | A63B 21/00181 |

* cited by examiner

ROTATOR CUFF EXERCISE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise therapy equipment, more specifically, a rotator cuff exercise device.

SUMMARY OF INVENTION

The rotator cuff exercise device comprises a ring unit, a mounting board, and pair of mounting tracks. The rotator cuff exercise device may be adapted to exercise joints and muscles or may prevent the loss of flexibility in an elbow or a shoulder blade. The rotator cuff exercise device may be particularly suited for therapy after an injury involving a rotator cuff. A handle may detachably couple to an individual rotatable ring selected from one or more rotatable rings of the ring unit may be adapted to be grasped by a hand of the user. The handle may be operable to move the individual rotatable ring in a circular motion. The circular motion of the handle may exercise the joints and muscles of the user. The ring unit may be raised and lowered by moving the mounting board vertically within the pair of mounting tracks.

An object of the invention is to exercise joints and muscle of a user.

Another object of the invention is to provide a handle that detachably couples to a rotatable ring.

A further object of the invention is to guide the rotation of the rotatable ring using one or more stationary rings that are adjacent to the rotatable ring.

Yet another object of the invention is to provide resistance tabs to adjust the effort require to rotate the rotatable ring.

These together with additional objects, features and advantages of the rotator cuff exercise device will be readily apparent to those of ordinary skill in the art upon reading the following detailed description of the presently preferred, but nonetheless illustrative, embodiments when taken in conjunction with the accompanying drawings.

In this respect, before explaining the current embodiments of the rotator cuff exercise device in detail, it is to be understood that the rotator cuff exercise device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotator cuff exercise device.

It is therefore important that the claims be regarded as including such equivalent construction insofar as they do not depart from the spirit and scope of the rotator cuff exercise device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
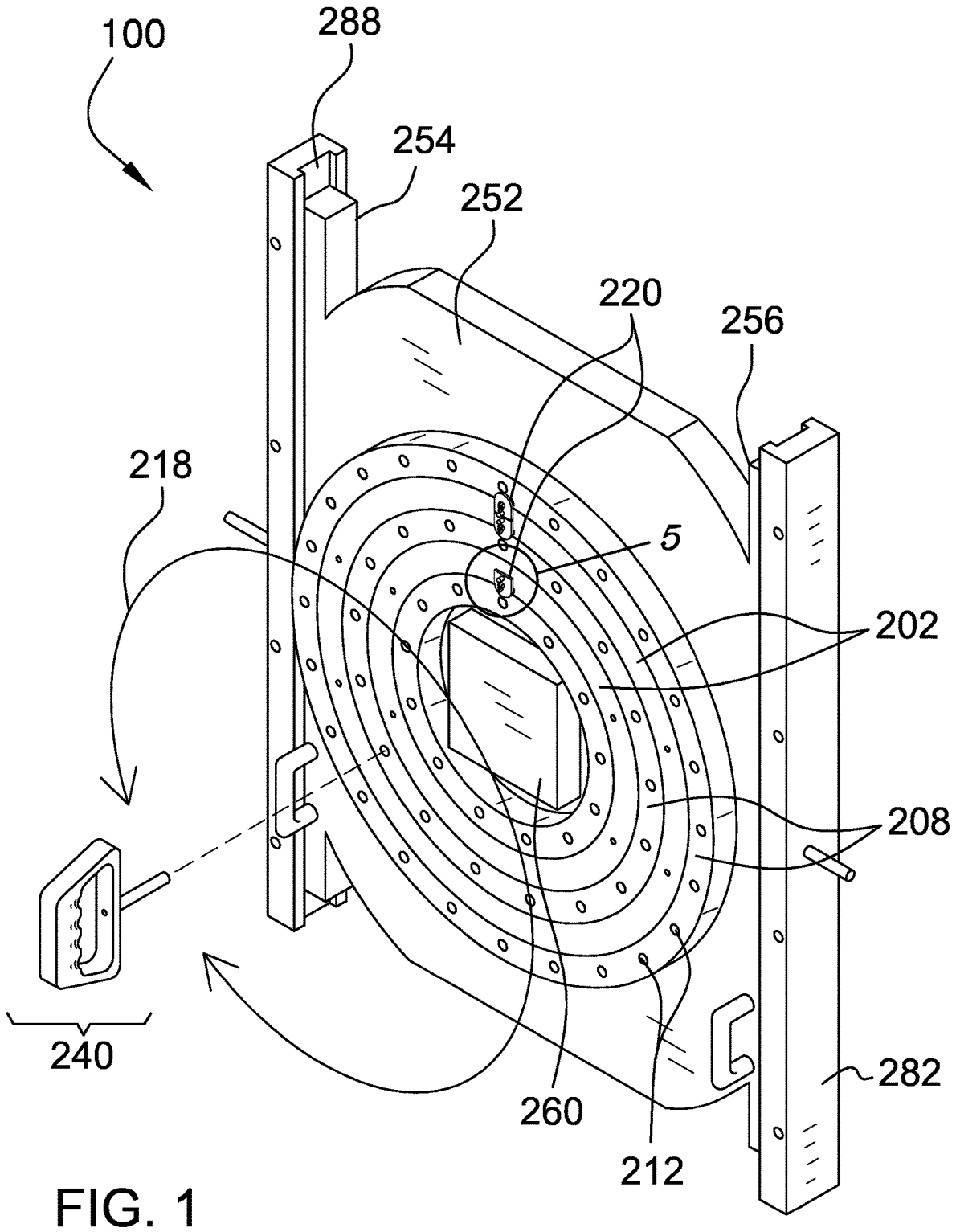
FIG. 1 is an isometric view of a device of the disclosure.
Figure 2:
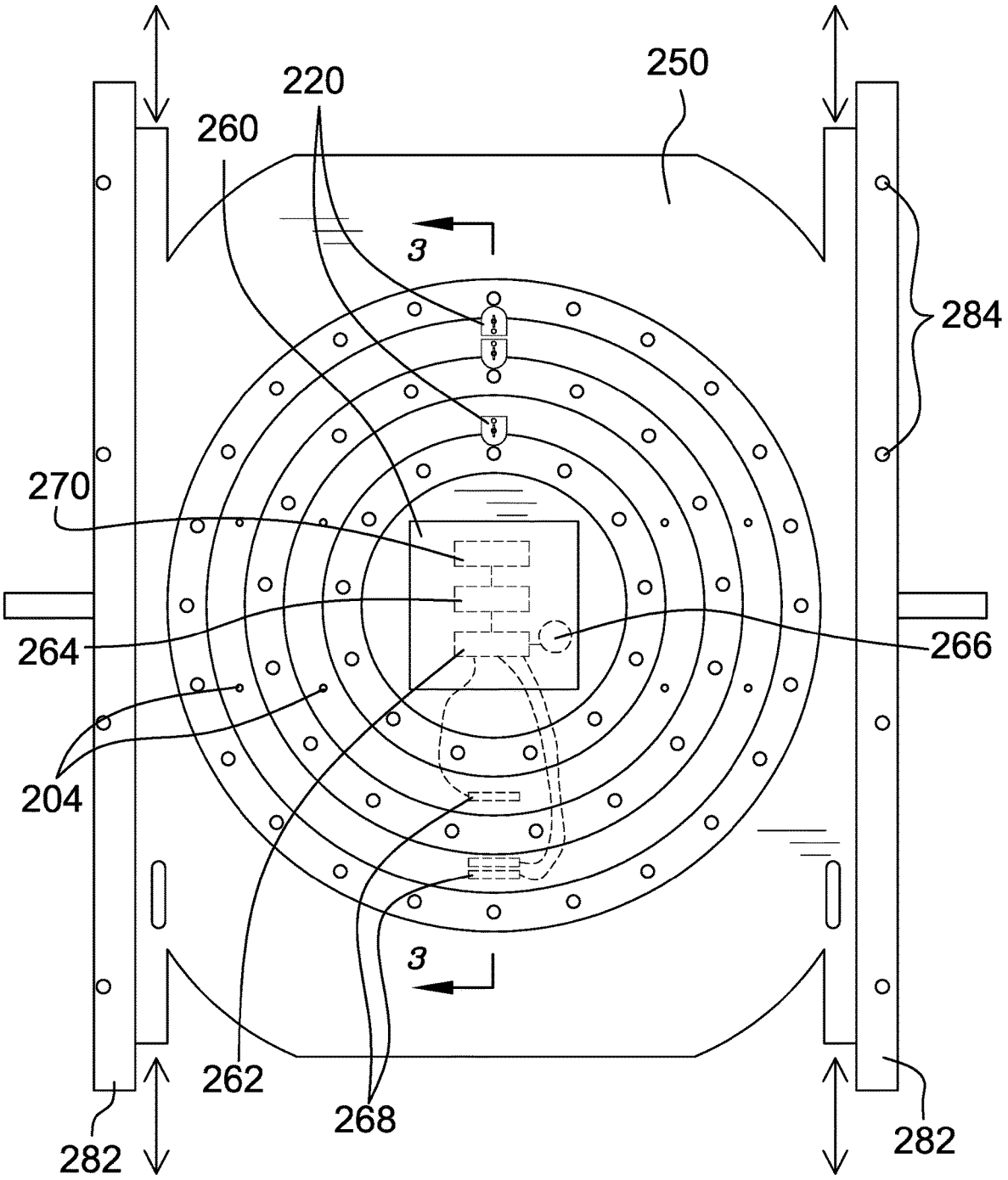
FIG. 2 is a front view of a device of the disclosure.
Figure 3:
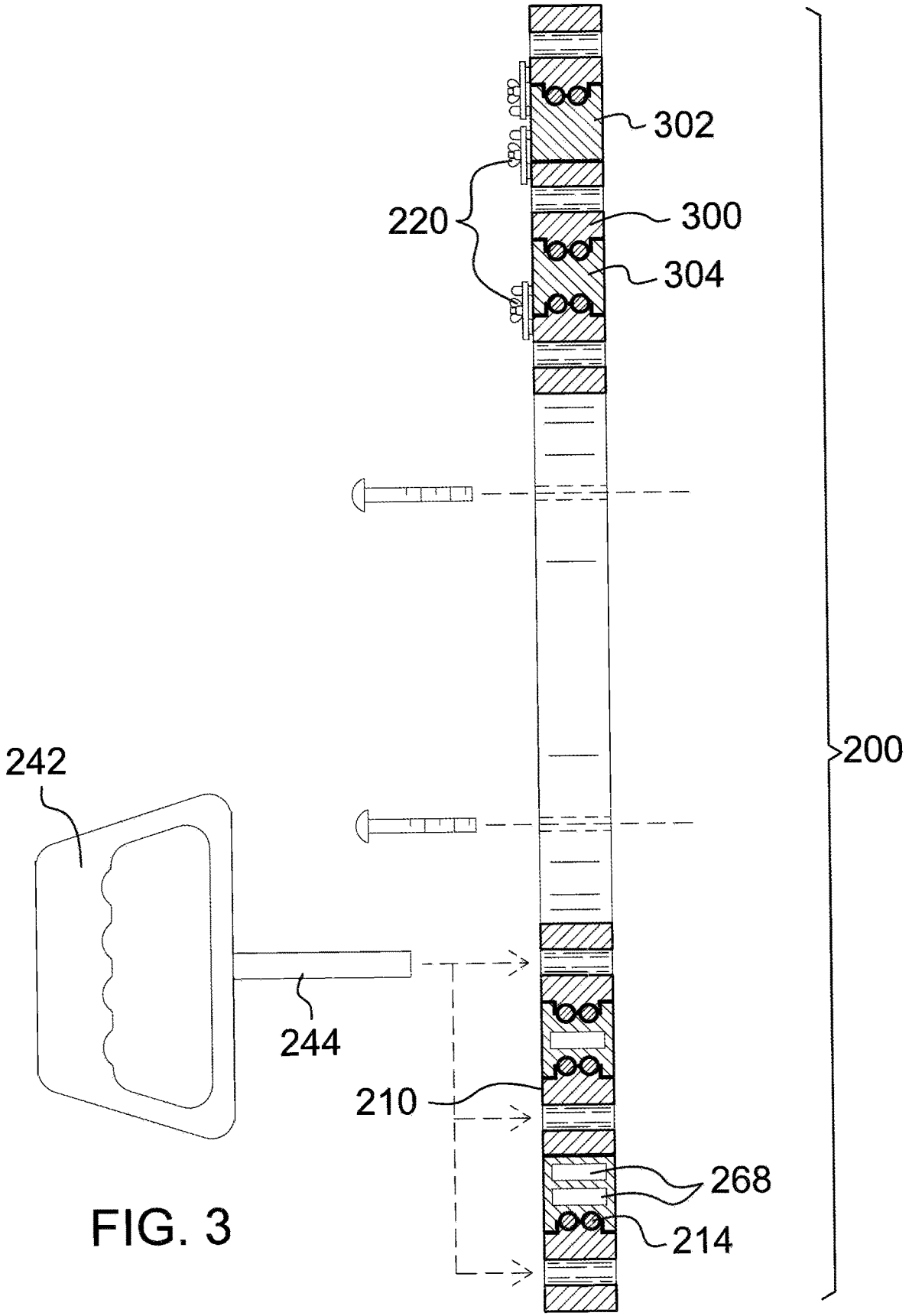
FIG. 3 is a cross-sectional view of a device of the disclosure across 3-3 as shown in FIG. 2.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 5.

The rotator cuff exercise device 100 (hereinafter invention) comprises a ring unit 200, a mounting board 250, and pair of mounting tracks 280. The invention 100 may be adapted to exercise joints and muscles of a user. Such exercise may be beneficial after injury or surgery. Alternatively, the exercise may prevent the loss of flexibility in an elbow or a shoulder blade. The invention 100 may be particularly suited for therapy after an injury involving a rotator cuff. A handle 240 detachably coupled to an individual rotatable ring 210 selected from one or more rotatable rings 208 of the ring unit 200 may be adapted to be grasped by a hand of the user. The handle 240 may be operable to move the individual rotatable ring 210 in a circular motion 218. The circular motion 218 of the handle 240 may exercise the joints and muscles of the user. The ring unit 200 may be raised and lowered by moving the mounting board 250 vertically within the pair of mounting tracks 280.

The ring unit 200 may comprise one or more stationary rings 202, the one or more rotatable rings 208, one or more resistance tabs 220, and the handle 240. The one or more rotatable rings 208 may be different diameters. The one or more stationary rings 202 may be different diameters. The one or more rotatable rings 208 and the one or more stationary rings 202 may be different diameters. The one or more rotatable rings 208 and the one or more stationary rings 202 may be alternately nested in a concentric pattern. The outer diameter of an interior ring 300 of the ring unit 200 may be less than or equal to the inner diameter of a superior ring 302 that surrounds the interior ring 300. The inner diameter of the interior ring 300 may be greater than or equal to the outer diameter of an inferior ring 304 that is surrounded by the interior ring 300. Note that not all of the interior rings 300 will have superior rings and not all of the interior rings 300 will have inferior rings.

The one or more stationary rings 202 may be coupled to a backboard 252 of the mounting board 250 via a plurality of stationary ring mounting hardware 206 and a plurality of stationary ring mounting holes 204. Each of the one or more stationary rings 202 may be slidably coupled to at least one of the individual rotatable rings 210 such that the individual rotatable rings 210 may rotate. The one or more rotatable rings 208 may be separated from the one or more stationary rings 202 via a plurality of bearings 214 such that friction between the one or more stationary rings 202 and the one or more rotatable rings 208 is reduced.

The one or more rotatable rings 208 may provide one or more circular paths for cycling the handle 240. The one or more rotatable rings 208 may comprise a plurality of spindle holes 212. The handle 240 may be coupled to one of the one or more rotatable rings 208 by placing a spindle 244 of the handle 240 into one of the plurality of spindle holes 212. The diameter of the individual rotatable ring 210 where the handle 240 is coupled may determine the size of the path that the handle 240 follows as the handle 240 is cycled around the individual rotatable ring 210.

The one or more resistance tabs 220 may be adapted to vary the resistance experienced by the user while the user cycles the handle 240. An individual resistance tab 222 selected from the one or more resistance tabs 220 may comprise a positioning peg 224, a tab body 226, a resistance pad 228, and an adjuster 230. The individual resistance tab 222 may be coupled to one of the one or more stationary rings 202 via the positioning peg 224. The tab body 226 may be suspended away from the one or more stationary rings 202 and the one or more rotatable rings 208 by the positioning peg 224. The resistance pad 228 may be movably coupled to the tab body 226 and located between the tab body 226 and an adjacent rotatable ring 234. The resistance pad 228 may be moved towards or away from the adjacent rotatable ring 234 by manipulating the adjuster 230. In some embodiments, the adjuster 230 may be a thumbscrew.

The handle 240 may comprise a hand grip 242 and the spindle 244. The handle 240 may be removably coupled to one of the one or more rotatable rings 208 by inserting the spindle 244 into one of the plurality of spindle holes 212. The handle 240 may be operable to rotate the individual rotatable ring 210 by grasping the hand grip 242 and moving the hand grip 242 in a path that is parallel to the plane of the one or more rotatable rings 208. The handle 240 may be free to pivot around the axis of the spindle 244 as the individual rotatable ring 210 rotates.

The mounting board 250 may support the one or more stationary rings 202 and the one or more rotatable rings 208 in a vertical orientation. The mounting board 250 may permit the ring unit 200 to be used while mounted to a support structure. The backboard 252 may be a planar surface that the one or more stationary rings 202 are coupled to. A left slide rail 254 and a right slide rail 256 may present vertically oriented surfaces on the sides of the backboard 252. The left slide rail 254 and the right slide rail 256 may be slidably coupled to the pair of mounting tracks 280 to such that the height of the mounting board 250 may be varied by sliding the mounting board 250 up and down within the pair of mounting tracks 280.

The mounting board 250 may comprise an electronics housing 260. The electronics housing 260 may house a microprocessor 262, a display panel 264, a sound transducer 266, and a battery 270. The microprocessor 262 may be a computer processor that incorporates the functions of a central processing unit in the form of one or more integrated circuits. The microprocessor 262 may be a multipurpose, clock driven, register based, digital-integrated circuit. The microprocessor 262 may accept binary data as input, process the binary data according to instructions stored in memory contained within the microprocessor 262, and provide results as output. The microprocessor 262 may contain both combinational logic and sequential digital logic. The microprocessor 262 may operate on numbers and symbols represented in the binary numeral system. The microprocessor 262 may comprise one or more internal memories for storing one or more programs and data. As non-limiting examples, the one or more programs may instruct the microprocessor 262 to acquire information regarding the rotation of the one or more rotatable rings 208 from a plurality of sensors 268 coupled to the ring unit 200, may instruct the microprocessor 262 to report the speed, direction, number of revolutions, elapsed time, or combinations thereof on the display panel 264 mounted on the front of the electronics housing 260, and may instruct the microprocessor 262 to monitor and report the charge level of the battery 270. The plurality of sensors 268 may detect motion of the one or more rotatable rings 208. As non-limiting examples, the plurality of sensors 268 may use mechanical technology, magnetic technology, optical technology, or combinations thereof.

The sound transducer 266 may produce audible sounds under control of the microprocessor 262. The sound transducer 266 may be used to audibly indicate the achievement of a goal or a warning. As non-limiting examples, the sound transducer 266 may be used to indicate the end of a time interval, indicate completion of a prescribed number of ring rotations, or indicate ring rotation within or outside of a speed goal.

The battery 270 may comprise one or more energy-storage devices. The battery 270 may be a source of electrical energy to operate the microprocessor 262, the display panel 264, the sound transducer 266, and the plurality of sensors 268. The battery 270 may be replaceable or rechargeable.

The pair of mounting tracks 280 may support the mounting board 250 at multiple elevations such that the height of the ring unit 200 may be varied. The pair of mounting tracks 280 may be installed to the right of the mounting board 250 and to the left of the mounting board 250 at a spacing that is complementary to the width of the mounting board 250. The left slide rail 254 and the right slide rail 256 may slide vertically within the pair of mounting tracks 280. An individual mounting track 282 selected from the pair of mounting tracks 280 may comprise a channel 288 for guiding the mounting board 250. The pair of mounting tracks 280 may be mounted to the support structure via a plurality of track mounting holes 284 and a plurality of track mounting hardware 286. As non-limiting examples, the support structure may be a wall or to a rolling stand 290.

The rolling stand 290 may comprise one or more vertical supports 292, a base support 296, and a plurality of wheels 298. The rolling stand 290 may support the ring unit 200 in a vertical position and may permit the ring unit 200 to be moved for storages and for use. The one or more vertical supports 292 may comprise a left upright 294 and a right upright 295 to which the pair of mounting tracks 280 may be coupled. The base support 296 may comprise a horizontally oriented armature that provides stability. The plurality of wheels 298 may be coupled to the underside of the base support 296 and may reduce friction as the rolling stand 290 is moved horizontally.

In use, the invention 100 is mounted on a support structure such that a ring unit 200 is elevated above waist-level of a user. In some embodiments, the invention 100 may be elevated by mounting the invention 100 onto a rolling stand 290. The user may insert a handle 240 into one of a plurality of spindle holes 212 on an individual rotatable ring 210 that corresponds to the range of motion that is desired, based upon the diameter of the individual rotatable ring 210. The user may adjust a resistance pad 228 associated with the individual rotatable ring 210 to increase or decrease the effort required to move the individual rotatable ring 210. The user may move the individual rotatable ring 210 in a circular motion 218 to exercise joints and muscles.

Figure 4A:
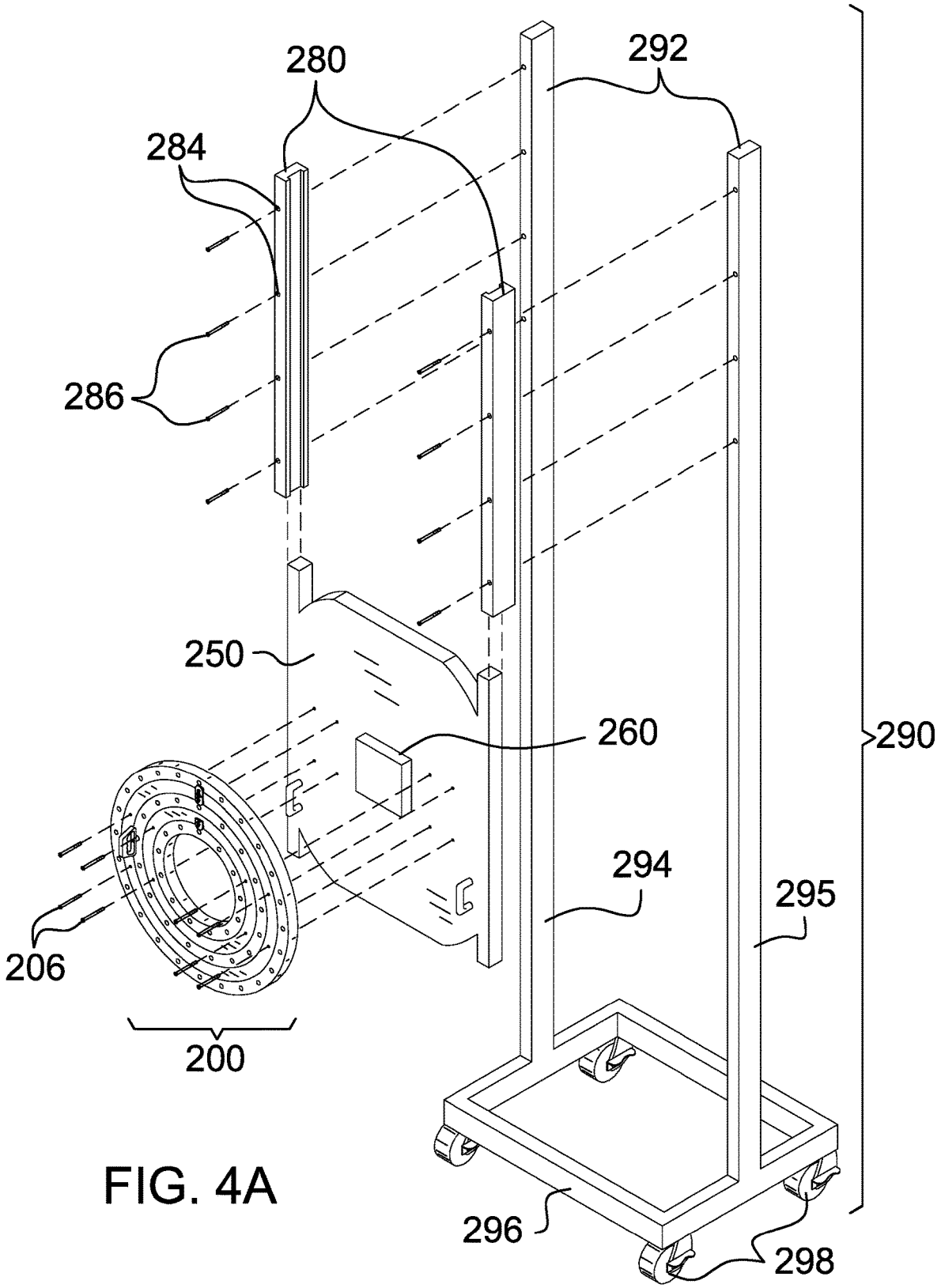
FIG. 4A is an exploded view of a device of the disclosure illustrating the rolling stand.
Figure 4B:
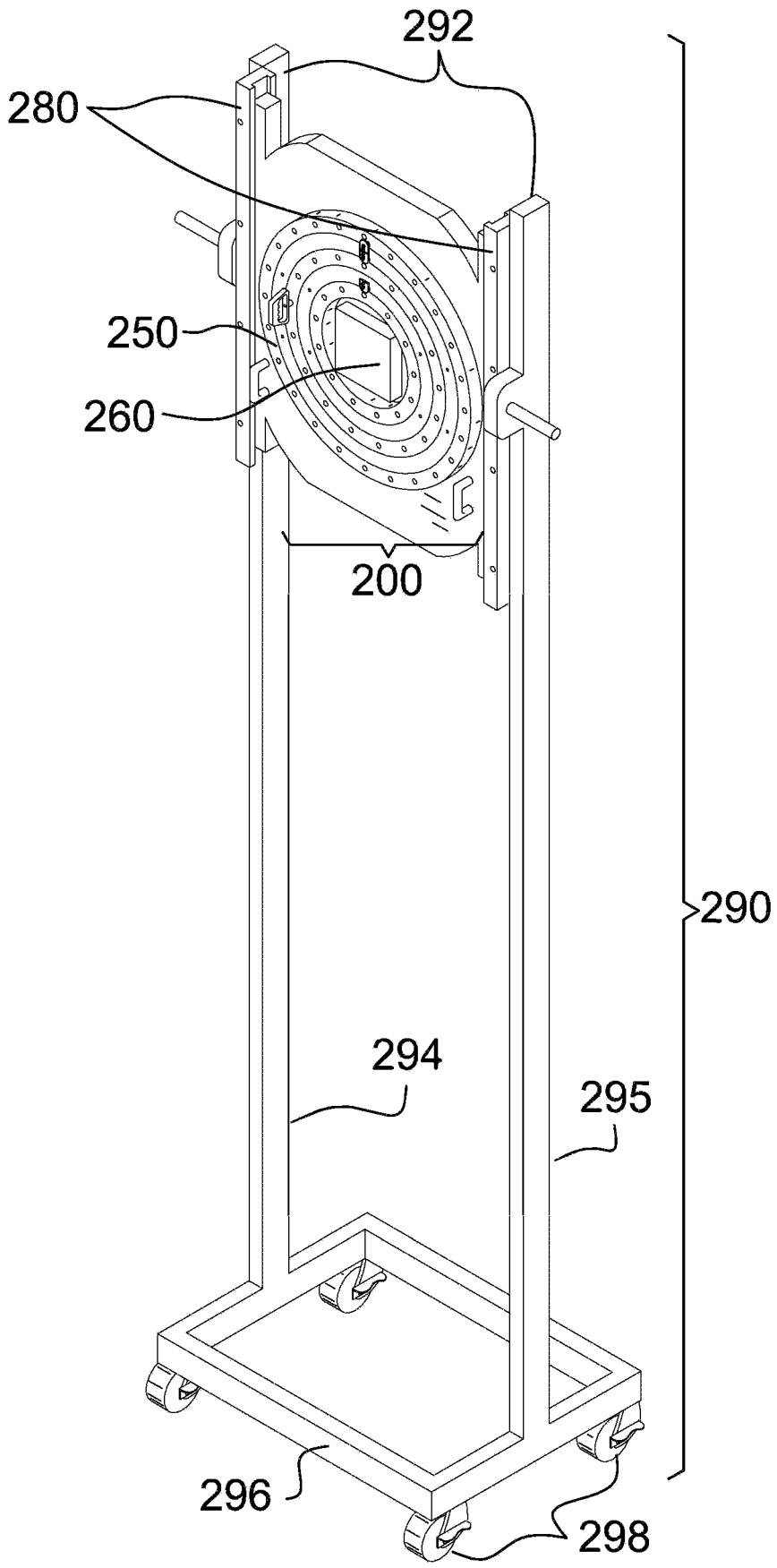
FIG. 4B is a perspective view of a device of the disclosure.
Figure 4C:
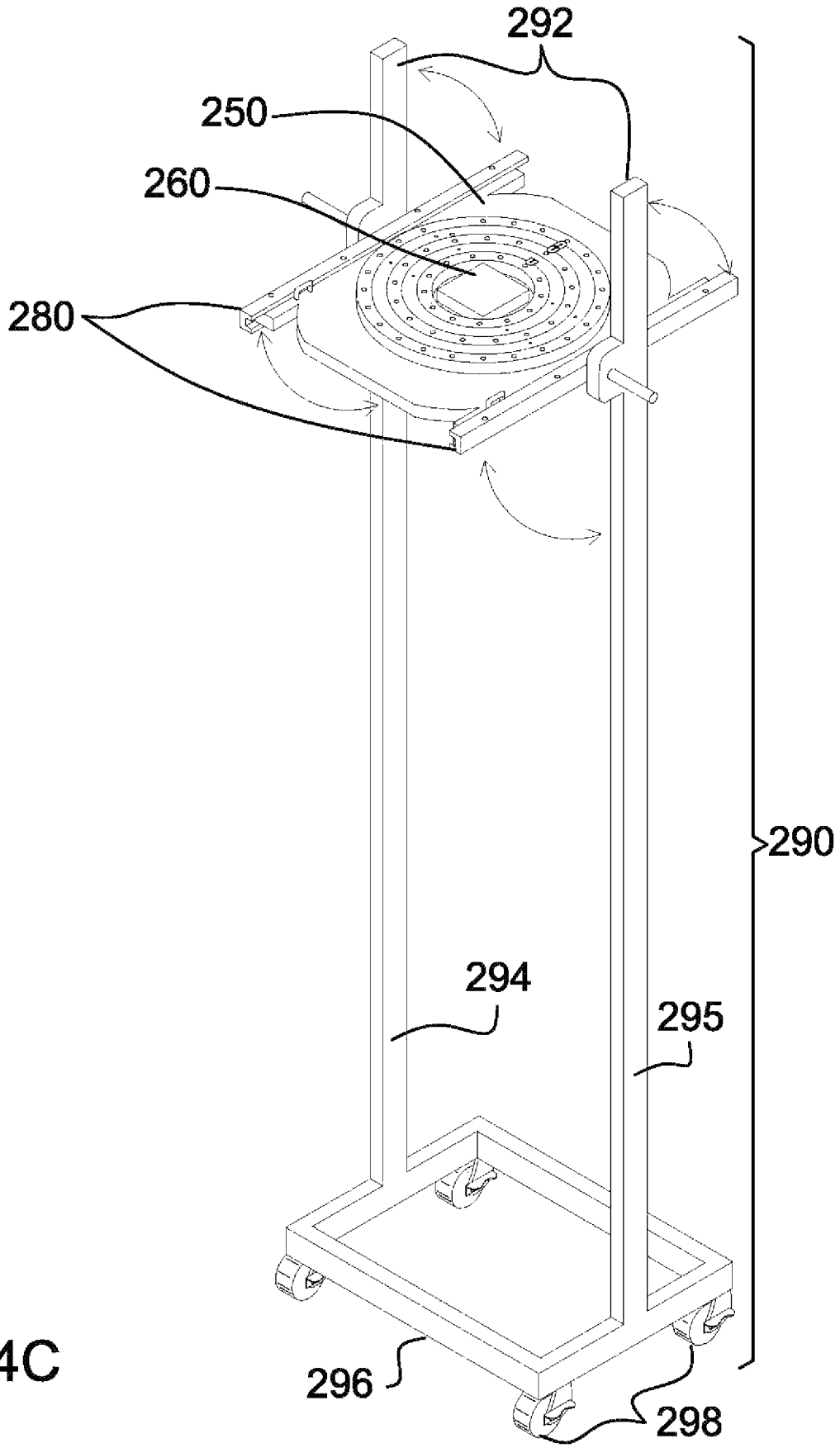
FIG. 4C is another perspective view of a device of the disclosure.
Figure 5:
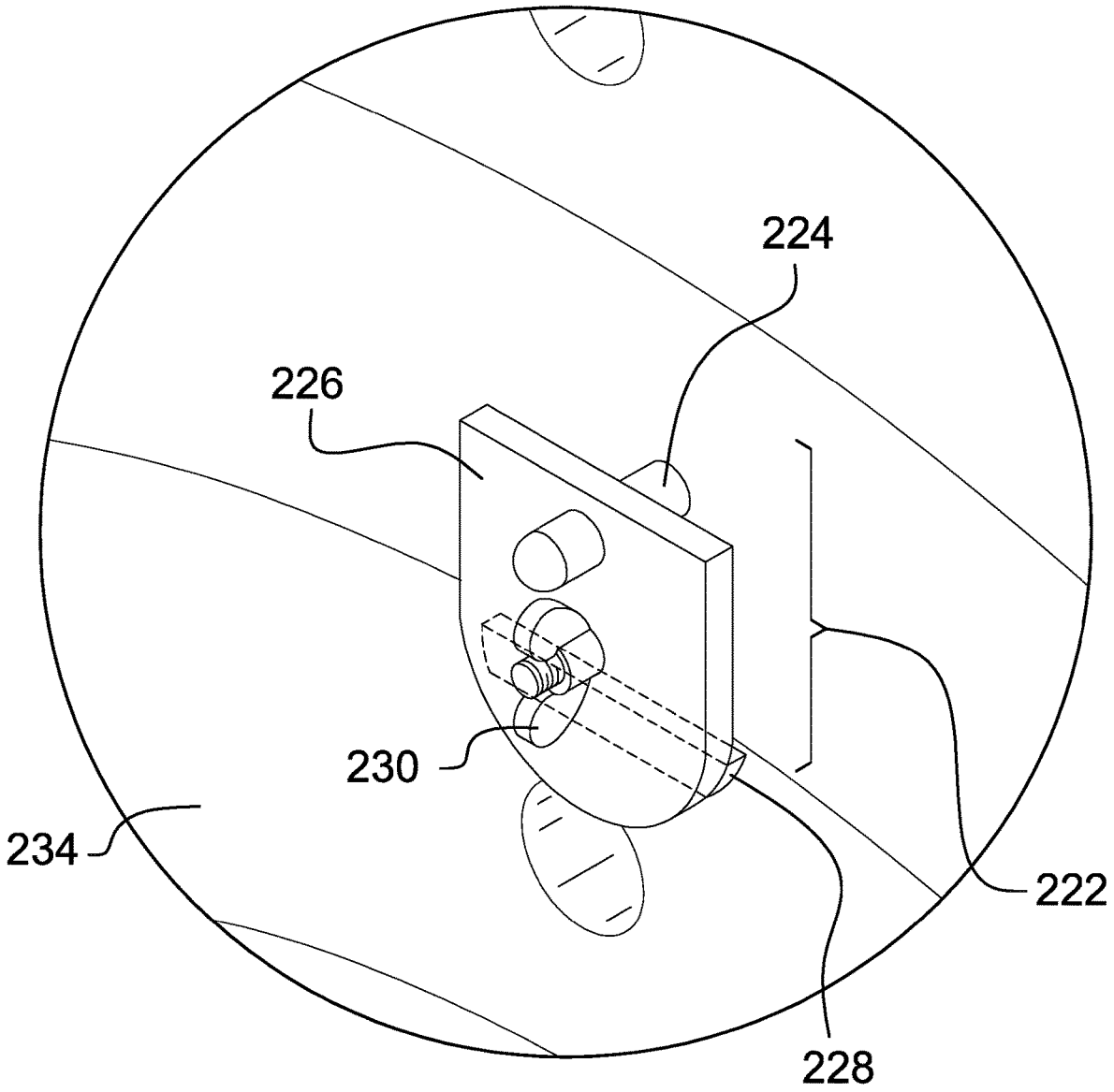
FIG. 5 is an isometric detail view of an individual resistance tab of the disclosure.

Referring to FIGS. 4*b* and 4C, it shall be noted that the invention 100 may also be able to rotate at different angles with respect to a horizontal axis.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, the word "correspond" indicates that a first object is in some manner linked to a second object in a one to one relationship or that one or more properties shared by two or more objects match, agree, or align within acceptable manufacturing tolerances.

As used herein, the words "couple", "couples", "coupled" or "coupling", may refer to connecting, either directly or indirectly, and does not necessarily imply a mechanical connection.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "diameter" of an object is a straight line segment that passes through the center (or center axis) of an object. The line segment of the diameter is terminated at the perimeter or boundary of the object through which the line segment of the diameter runs.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "grip" may refer to a covering that is placed over a hand hold, handle, shaft, or other object.

As used herein, "handle" may refer to an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "housing" is a rigid or semi-rigid casing that encloses and protects one or more devices.

As used herein, "inside diameter" or "inner diameter" refers to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used herein, "mounting hardware" may refer to mechanical devices that are used to attach one object to another, including devices whose only purpose is to improve aesthetics. As non-limiting examples, mounting hardware may include screws, nuts, bolts, washers, rivets, crossbars, hooks, collars, nipples, standoffs, knobs, caps, plates, rails, and brackets.

As used in this disclosure, "orientation" refers to the positioning and/or angular alignment of a first object relative to a second object or relative to a reference position or reference direction.

As used herein, "outside diameter" or "outer diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used herein, "thumb screw" and "wing nut" refer to fasteners that are designed to be tightened and loosened by hand without the use of tools. As non-limiting examples, thumb screws and wing nuts may be screws, bolts, or nuts that include any or all of the following features: oversized dimensions, knurled sides, one or more upward extensions, or one or more lateral extensions.

As used in this disclosure, a "track" is a device that is used to control the path of motion of an object in at least one dimension.

As used in this disclosure, a "transducer" is a device that converts a physical quantity, such as pressure or brightness into an electrical signal or a device that converts an electrical signal into a physical quantity.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A rotator cuff exercise device comprising:

a ring unit, a mounting board, and a pair of mounting tracks;

wherein the rotator cuff exercise device is adapted to exercise joints and muscles of a user;

wherein a handle detachably coupled to an individual rotatable ring selected from one or more rotatable rings of the ring unit is adapted to be grasped by a hand of the user;

wherein the handle is operable to move the individual rotatable ring in a circular motion;

wherein the ring unit is raised and lowered by moving the mounting board vertically within the pair of mounting tracks;

wherein the ring unit comprises one or more stationary rings, the one or more rotatable rings, one or more resistance tabs, and the handle;

wherein two or more of the rotatable rings have different diameters;

wherein two or more of the stationary rings have different diameters;

wherein the one or more rotatable rings and the one or more stationary rings have different diameters from each other;

wherein the one or more rotatable rings and the one or more stationary rings are alternately nested in a concentric pattern;

wherein an outer diameter of an interior ring of the one or more rotatable rings is less than or equal to an inner diameter of a superior ring of the one or more rotatable rings that surrounds the interior ring;

wherein an inner diameter of the interior ring is greater than or equal to an outer diameter of an inferior ring that is surrounded by the interior ring;

wherein the one or more stationary rings are coupled to a backboard of the mounting board via a plurality of stationary ring mounting hardware and a plurality of stationary ring mounting holes;

wherein each of the one or more stationary rings are slidably coupled to at least one of the one or more rotatable rings such that the at least one of the one or more rotatable rings can rotate.

2. The rotator cuff exercise device according to claim 1 wherein the one or more rotatable rings are separated from the one or more stationary rings via a plurality of bearings such that friction between the one or more stationary rings and the one or more rotatable rings is reduced.

3. The rotator cuff exercise device according to claim 2 wherein the one or more rotatable rings provide one or more circular paths for cycling the handle;

wherein the one or more rotatable rings comprise a plurality of spindle holes;

wherein the handle is coupled to the individual rotatable ring by placing a spindle of the handle into one of the plurality of spindle holes;

wherein a diameter of the individual rotatable ring where the handle is coupled determines a size of a path that the handle follows as the handle is cycled around the individual rotatable ring.

4. The rotator cuff exercise device according to claim 3 wherein the one or more resistance tabs are adapted to vary a resistance experienced by the user while the user cycles the handle.

5. The rotator cuff exercise device according to claim 4 wherein an individual resistance tab selected from the one or more resistance tabs comprises a positioning peg, a tab body, a resistance pad, and an adjuster;

wherein the individual resistance tab is coupled to one of the one or more stationary rings via the positioning peg;

wherein the tab body is suspended away from the one or more stationary rings and the one or more rotatable rings by the positioning peg;

wherein the resistance pad is movably coupled to the tab body and located between the tab body and the ring unit;

wherein the resistance pad is moved towards or away from the adjacent rotatable ring by manipulating the adjuster.

6. The rotator cuff exercise device according to claim 5 wherein the adjuster is a thumbscrew.

7. The rotator cuff exercise device according to claim 5 wherein the handle comprises a hand grip and the spindle;

wherein the handle is removably coupled to the individual rotatable ring by inserting the spindle into one of the plurality of spindle holes;

wherein the handle is operable to rotate the individual rotatable ring by grasping the hand grip and moving the hand grip in a path that is parallel to the plane of the one or more rotatable rings;

wherein the handle pivots around an axis of the spindle as the individual rotatable ring rotates.

8. The rotator cuff exercise device according to claim 7 wherein the mounting board supports the one or more stationary rings and the one or more rotatable rings in a vertical orientation;

wherein the backboard is a planar surface that the one or more stationary rings are coupled to;

wherein a left slide rail and a right slide rail present vertically oriented surfaces on sides of the backboard;

wherein the left slide rail and the right slide rail are slidably coupled to the pair of mounting tracks to such that a height of the mounting board is varied by sliding the mounting board up and down within the pair of mounting tracks.

9. The rotator cuff exercise device according to claim 8 wherein the mounting board comprises an electronics housing;

wherein the electronics housing houses a microprocessor, a display panel, a sound transducer, and a battery;

wherein the microprocessor is a computer processor that incorporates functions of a central processing unit in form of one or more integrated circuits;

wherein the microprocessor is a multipurpose, clock driven, register based, digital-integrated circuit;

wherein the microprocessor accepts binary data as input, process the binary data according to instructions stored in memory contained within the microprocessor, and provide results as output;

wherein the microprocessor contains both combinational logic and sequential digital logic;

wherein the microprocessor operates on numbers and symbols represented in the binary numeral system;

wherein the microprocessor comprises one or more internal memories for storing one or more programs and data.

10. The rotator cuff exercise device according to claim 9 wherein the one or more programs instruct the microprocessor to acquire information regarding the rotation of the one or more rotatable rings from a plurality of sensors coupled to the ring unit, instruct the microprocessor to report speed, direction, number of revolutions, elapsed time, or combinations thereof on the display panel mounted on a front of the electronics housing, and instruct the microprocessor to monitor and report a charge level of the battery.

11. The rotator cuff exercise device according to claim 10 wherein the plurality of sensors detect motion of the one or more rotatable rings.

12. The rotator cuff exercise device according to claim 11 wherein the sound transducer produces audible sounds under control of the microprocessor;

wherein the sound transducer is used to audibly indicate an achievement of a goal or a warning.

13. The rotator cuff exercise device according to claim 12 wherein the battery comprises one or more energy-storage devices;

wherein the battery is a source of electrical energy to operate the microprocessor, the display panel, the sound transducer, and the plurality of sensors;

wherein the battery is replaceable or rechargeable.

14. The rotator cuff exercise device according to claim 13 wherein the pair of mounting tracks support the mounting board at multiple elevations such that the height of the ring unit is variable;

wherein the pair of mounting tracks is installed to a right of the mounting board and to a left of the mounting board at a spacing that is complementary to a width of the mounting board;

wherein the left slide rail and the right slide rail slide vertically within the pair of mounting tracks;

wherein an individual mounting track selected from the pair of mounting tracks comprises a channel for guiding the mounting board;

wherein the pair of mounting tracks is mounted to a support structure via a plurality of track mounting holes and a plurality of track mounting hardware.

15. The rotator cuff exercise device according to claim 14 wherein a rolling stand comprises one or more vertical supports, a base support, and a plurality of wheels;

wherein the rolling stand supports the ring unit in a vertical position and permits the ring unit to be moved for storage and for use;

wherein the one or more vertical supports comprise a left upright and a right upright to which the pair of mounting tracks are coupled;

wherein the base support comprises a horizontally oriented armature that provides stability;

wherein the plurality of wheels are coupled to an underside of the base support and reduce friction as the rolling stand is moved horizontally.

* * * * *